US005305979A

United States Patent [19]

Hanson, Jr.

[11] Patent Number: 5,305,979

[45] Date of Patent: Apr. 26, 1994

[54] ASSEMBLY CONVERTIBLE BETWEEN HOUSE ID DISPLAY SIGN AND SUPPORT SHELF

[76] Inventor: John D. Hanson, Jr., 1104 BB Mary La., Port Tobacco, Md. 20677

[21] Appl. No.: 849,279

[22] Filed: Mar. 10, 1992

[51] Int. Cl.[5] ..... G09F 7/00; G09F 7/16

[52] U.S. Cl. ..... 248/291; 40/564; 283/117

[58] Field of Search ..... 248/291, 293, 240.4; 40/553, 574; 283/117

[56] References Cited

U.S. PATENT DOCUMENTS

| | | | |
|---|---|---|---|
| 2,714,920 | 8/1955 | Hancock | 155/83 |
| 3,420,488 | 1/1969 | Sisler | 248/291 |
| 3,730,107 | 5/1973 | Bergkamp et al. | 108/39 |
| 4,632,457 | 12/1986 | Hofrichter et al. | 297/335 |
| 5,007,190 | 4/1991 | Shyu | 40/574 |
| 5,193,695 | 3/1993 | Mann | 248/291 |

*Primary Examiner*—Douglas D. Watts

*Attorney, Agent, or Firm*—John R. Flanagan

[57] ABSTRACT

An assembly convertible between a raised house ID display sign configuration and a lowered support shelf configuration includes a lower base plate stationarily attached on a wall portion of a house adjacent to an entry door, an upper face plate mounting ID indicia to identify the house, and a plurality of hinges attached respectively between the lower base plate and upper face member to enable pivoting of the upper face plate relative to the lower base plate between the raised and lowered configurations. The assembly also includes an electrical light mounted at a side edge portion of the lower base plate to provide illumination to an area of the entry door adjacent thereto. The light is switched on and off by a button mounted on the lower base plate being respectively engaged and disengaged by the upper face plate when the assembly is correspondingly converted between the support shelf and ID display sign configurations.

19 Claims, 2 Drawing Sheets

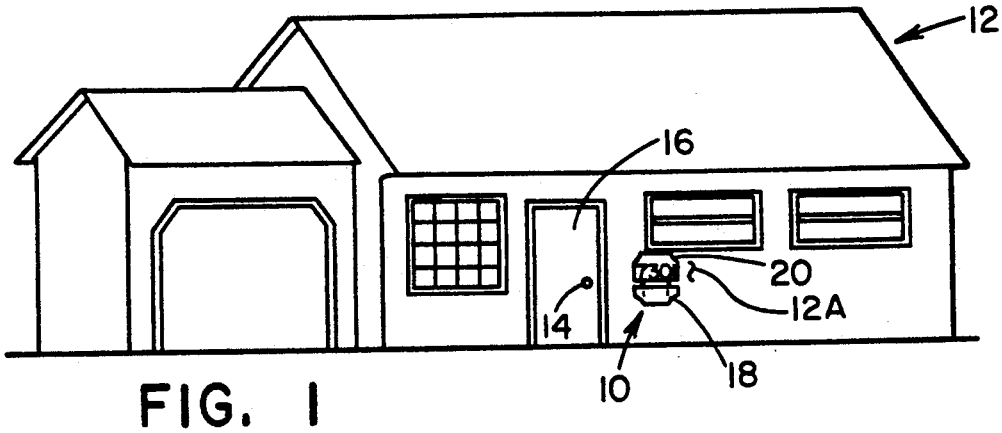
FIG. 1
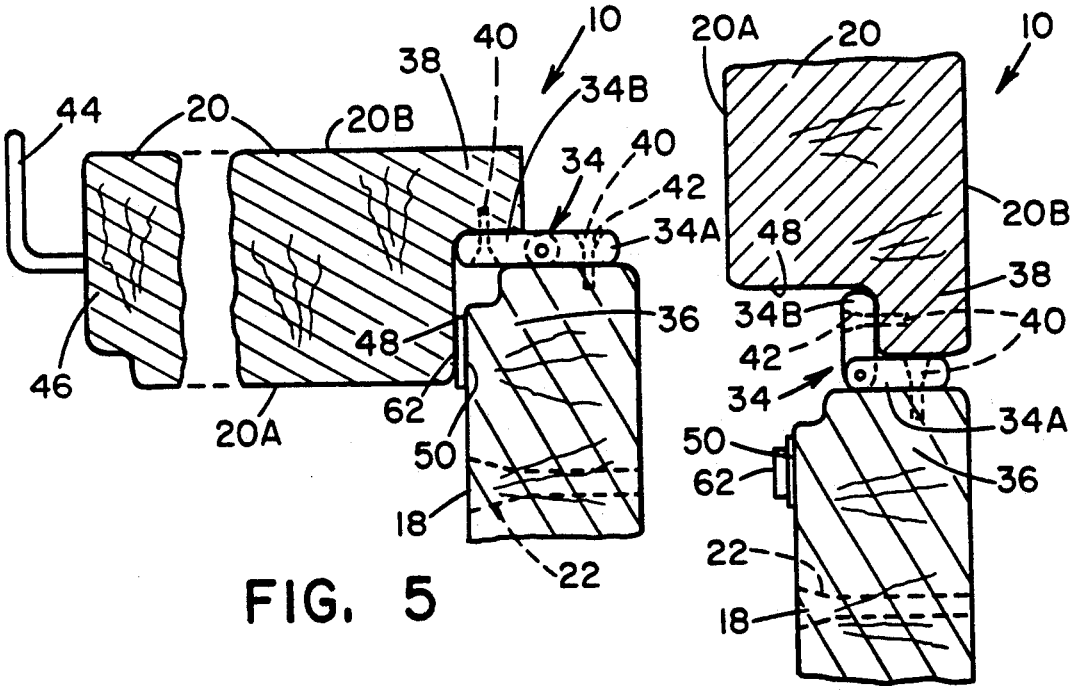
FIG. 5
FIG. 4
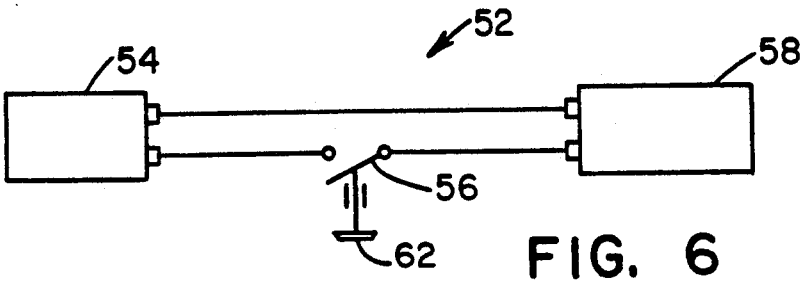
FIG. 6

ASSEMBLY CONVERTIBLE BETWEEN HOUSE ID DISPLAY SIGN AND SUPPORT SHELF

BACKGROUND OF THE INVENTION

1. Field of the Invention

The present invention generally relates to multipurpose time and effort saving accessories and, more particularly, is concerned with an assembly convertible between a house identification (ID) display sign and a support shelf.

2. Description of the Prior Art

Situations often arise where a person needs an "extra" hand, so to speak, to handle several tasks at once. One such situation is when a person holding one or more packages at the same time tries to locate his or her house key in order to unlock the entrance door to the house. There may be no convenient place available nearby at which to temporarily rest the packages while both hands are used to locate the key and open the door. Also, if it is during evening hours, the person will usually have to blindly struggle about in order to find the door lock and insert the key into it. The presence of inclement weather, such as rain, snow or cold temperatures, will complicate the situation even further.

Frequently, the lack of the "extra" hand results in the person dropping a package or the key. Consequently, a need exists for some mechanical device that will be convenient and easy to employ to assist a person in this particular situation. However, during periods when such device is not needed, it must be storable in a manner which is not obtrusive and does not detract from the exterior decor of the house.

SUMMARY OF THE INVENTION

The present invention provides a convertible assembly designed to satisfy the aforementioned need. The assembly of the present invention is located adjacent to the entry door and is quickly and easily convertible between a house identification (ID) display sign and a support shelf. When not converted to serve as a shelf to temporarily hold a package, the convertible assembly has the external appearance of a house ID display sign that is commonly found on many homes. The assembly can be converted into a temporary shelf by use of a single finger and preferably mounts a light aimed at the door lock. The light is switched on and off automatically when the assembly is correspondingly converted to the shelf configuration and then back to the sign configuration.

Accordingly, the present invention is directed to an assembly convertible between a house ID display sign and a support shelf which comprises: (a) a lower member having means for stationarily attaching the lower member on a wall portion of a house adjacent to an entry door; (b) an upper member having means for mounting ID indicia to the upper member for identifying the house; and (c) means for mounting the upper member to the lower member such that the upper member can be moved relative to the lower member between a house ID display sign configuration and a support shelf configuration. The lower member is a lower base plate, and the attaching means is a plurality of holes defined through the base plate and a plurality of fasteners installable through the holes. The upper member is an upper face plate having a pair of opposite front and rear sides, and the ID indicia mounting means is a bracket attached to the front side of the face plate having channels for removably receiving ID indicia.

The mounting means includes at least one pivotal hinge and preferably a plurality of pivotal hinges attached respectively to an upper edge of the lower base plate and a lower edge of the upper face plate so as to mount the upper face plate for pivotal movement relative to the lower base plate. The upper face plate is disposed in a substantially coplanar relation with the lower base plate when the upper face plate is at the house ID display sign configuration relative to the lower base plate. On the other hand, the upper face plate is disposed in a substantially perpendicular relation with the lower base plate when the upper base plate is at the support shelf configuration relative to the lower base plate.

The assembly also includes an electrical circuit having a light mounted to a side edge of one of the upper and lower plates for providing illumination to an area adjacent thereto and an electrical switch mounted to the one of the upper and lower plates and being connected between a source of electrical power and the light. Preferably, the source of electrical power is a direct current battery mounted to the one of the upper and lower plates. The light is switched on and off by a button of the switch on the one plate being respectively engaged and disengaged by the other plate when the assembly is correspondingly converted between the support shelf and ID display sign configurations.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective front view of a house having an assembly convertible between a house ID display sign and a support shelf in accordance with the present invention being mounted to the exterior of the house adjacent to a door knob on an entry door to the house.

FIG. 4 is an enlarged fragmentary vertical sectional view of the convertible assembly taken along line 4—4 of FIG. 2.

FIG. 5 is an enlarged fragmentary vertical sectional view of the convertible assembly taken along line 5—5 of FIG. 3.

FIG. 6 is a diagrammatic view of an electrical circuit in the convertible assembly of FIG. 2.

DETAILED DESCRIPTION OF THE INVENTION

Figure 2:
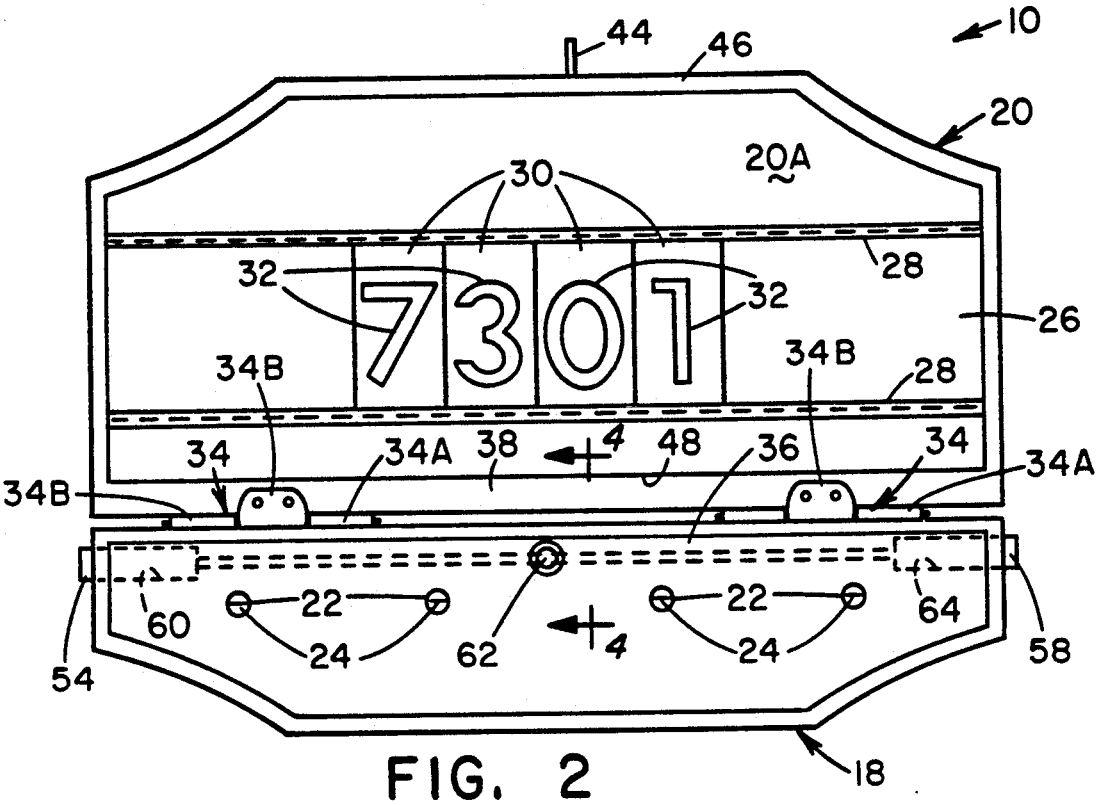
FIG. 2 is an enlarged front view of the convertible assembly in the house ID display sign configuration.
Figure 3:
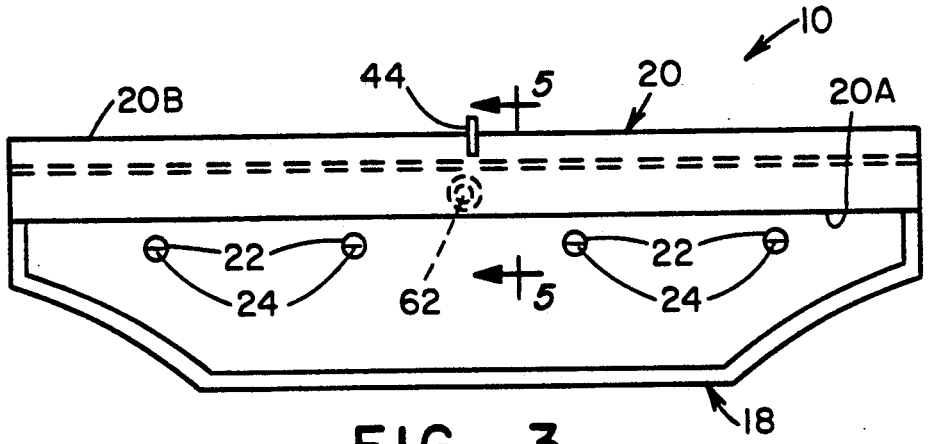
FIG. 3 is a front view of the convertible assembly in the support shelf configuration.

Referring to the drawings and particularly to FIG. 1, there is illustrated a convertible assembly of the present invention, generally designated 10, being mounted to the exterior of a house 12 at a location adjacent to a door knob 14 on an outside entry door 16 to the house 12. The assembly 10 is convertible between a house ID display sign configuration, as seen in FIGS. 1 and 2, and a support shelf configuration, as seen in FIG. 3. In the latter configuration, the assembly 10 provides an easily accessible shelf for temporarily holding a package while a person finds the door key and unlocks the door 16. When not converted to serve as a shelf, the assembly 10 has the external appearance of a conventional house ID display sign that is commonly found on many homes. It should be understood that the convertible assembly 10 of the present invention is applicable to any building. Thus, the term "house" is used herein for the sake of brevity and intended to refer to any building.

Referring to FIGS. 2 and 3, the convertible assembly 10 basically includes a lower base plate 18 and an upper face plate 20. The plates 18, 20 can be made from any suitable materials, such as wood or plastic, using conventional fabrication techniques. Referring also to FIGS. 4 and 5, the lower base plate 16 has attaching means, preferably, in the form of a plurality of holes 22 defined through the lower base plate 18 and a plurality of screw fasteners 24 installed through the holes 22 for attaching the lower base plate 18 in a stationary position on a wall portion 12A of the house 12 adjacent to the outside entry door 16. Other suitable attaching means, such as an adhesive, could be used within the purview of the present invention.

The upper face plate 20 has a pair of opposite front and rear sides 20A, 20B. The upper face plate 20 also has an ID indicia mounting means, preferably in the form of a bracket 26 attached horizontally across the front side 20A of the upper face plate 20. The bracket 26 has a pair of upper and lower channels 28 for removably receiving flat rectangular cards 30 containing ID indicia 32 thereon.

The convertible assembly 10 also includes mounting means, preferably, in the form of at least one and preferably a pair of spaced pivotal hinges 34 attached between the upper face plate 20 and lower base plate 18. In particular, the corresponding pivotally-connected halves 34A, 34B of the hinges 34 are respectively attached to an upper edge portion 36 of the lower base plate 18 and to a lower edge portion 38 of the upper face plate 20 by screws 40 inserted through holes 42 in the hinge halves 34A, 34B and threaded into the respective portions 36, 38 of the plates 18, 20. The pivotal hinges 34 enable the upper face plate 36 to undergo pivotal movement relative to the lower base plate 18 between the raised house ID display sign configuration of FIGS. 1, 2 and 4, in which the upper face plate 20 is disposed adjacent the wall portion 12A of the house 12 and extends upwardly in a coplanar relation with the lower base portion 18 and the lowered support shelf configuration of FIGS. 3 and 5 in which the upper face plate 36 is displaced from the wall portion 12A of the house 12 and provides an outwardly projecting, generally horizontal, support shelf for seating an object thereon. The upper face plate 20 has an element, preferably, in the form of a hook 44, threaded in the upper edge portion 46 of the upper face plate 20 for gripping by a single finger of a person to pivot the upper face plate 20 between the raised house ID display sign configuration and the lower support shelf configuration.

As seen in FIG. 4, when the upper face plate 20 is disposed in the raised ID display, a forward surface 48 of the lower edge portion 38 of the upper face plate 20 extends forwardly of and is disposed in a spaced relation above the upper edge portion 36 of the lower base plate 18. The forward surface 48 of the lower edge portion 38 of the upper face plate 20 is spaced sufficiently above and forwardly of the upper edge portion 36 of the lower edge plate 18 such that when the upper face plate 18 is pivoted downwardly relative to the lower base plate 18 to the lowered horizontal support shelf configuration of FIG. 5, the forward surface 48 is brought into contacting relation with the forward surface 50 of the upper edge portion 36 of the lower base plate 18. Such contacting relation maintains the upper face plate 18 in a generally perpendicular relation to the lower base plate 20.

Referring to FIGS. 2 and 4–6, the convertible assembly 10 further includes an electrical circuit 52 disposed within either the lower base plate 18 or the upper face plate 20, but preferably within the upper edge portion 36 of the lower base plate 18, as seen in FIG. 2. The electrical circuit 52 has an electical light in the form of a bulb 54 mounted to the lower base plate 18 for providing illumination to an area of the entry door 16 adjacent thereto and an electrical switch 56 mounted to the lower base plate 18. The electrical switch 56 is connected between the light bulb 54 and a source of electrical power, such as a direct current battery 58. Preferably, the light bulb 54 is mounted in a cavity 60 defined in a side edge portion of the lower base plate 18 which is aligned for providing illumination to the door knob 16 of the entry door 16. The battery 58 is mounted in another cavity 64 defined in an opposite side edge portion of the lower base plate 18.

Further, the electrical switch 56 is mounted within the upper edge portion 36 of the lower base plate 18 midway between the opposite side edge portions thereof. The electrical switch 56 has a button 62 projecting from the forward surface 50 of upper edge portion 36 of the lower base plate 18. The button 62 is engaged and depressed by the forward surface 48 of the lower edge portion 38 of the upper face plate 20 when the lower edge portion 38 of the upper face plate 20 is disposed in the contacting relation with the upper edge portion 36 of the lower base plate 18. The light bulb 54 is switched on and off by the button 62 mounted on the lower base plate 18 as the button 62 is respectively engaged (and depressed) and disengaged (and released) by the upper face plate 20 when the assembly 10 is correspondingly converted between the lowered support shelf and raised ID display sign configurations.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An assembly convertible between a house ID display sign and a support shelf, comprising:

(a) a lower member having means for stationarily attaching said lower member on a wall portion of a house adjacent to an entry door;

(b) an upper member having means for mounting ID indicia to said upper member for identifying the house;

(c) means for mounting said upper member to said lower member such that said upper member can be moved relative to said lower member between a house ID display sign configuration in which said upper member extends above and in a substantially coplanar relation with said lower member and a support shelf configuration in which said upper member extends outwardly from and generally above said lower member and in a substantially perpendicular relation with said lower member and is capable of seating an object thereon; and (d) means on said lower member for engaging and supporting said upper member when said upper member is moved to said substantially perpendicular relation to said lower member so as to retain said upper member in said support shelf configuration when an object is seated on said upper member.

2. The assembly of claim 1 wherein:

said lower member is a lower base plate; and said attaching means is a plurality of holes defined through said base plate and a plurality of fasteners installable through said holes.

3. The assembly of claim 1 wherein:

said upper member is an upper face plate having a pair of opposite front and rear sides; and said ID indicia mounting means is a bracket attached to said front side of said face plate having channels for removably receiving ID indicia.

4. The assembly of claim 1 wherein said mounting means includes at least one pivotal hinge attached respectively to an upper edge of said lower member and a lower edge of said upper member so as to mount said upper member for pivotal movement relative to said lower member.

5. The assembly of claim 1 further comprising:

(d) an electrical circuit having a light mounted to one of said upper and lower members for providing illumination to an area adjacent thereto.

6. The assembly of claim 5 wherein said electrical circuit also has an electrical switch mounted to said one of said upper and lower members and being connected between a source of electrical power and said light.

7. The assembly of claim 6 wherein said source of electrical power is a direct current battery mounted to said one of said upper and lower members.

8. The assembly of claim 1 wherein said upper member has a lower edge portion disposed in a spaced relation from an upper edge portion of said lower member when said upper member is at said house ID display sign configuration relative to said lower member and disposed in a contacting relation with said upper edge portion of said lower member when said upper member is at said support shelf configuration relative to said lower member.

9. The assembly of claim 8 further comprising:

(d) an electrical circuit having a light mounted at a side edge portion of said lower member for providing illumination to an area adjacent thereto.

10. An assembly convertible between a house ID display sign and a support shelf, comprising:

(a) a lower member having means for stationarily attaching said lower member on a wall portion of a house adjacent to an entry door;

(b) an upper member having means for mounting ID indicia to said upper member for identifying the house;

(c) means for mounting said upper member to said lower member such that said upper member can be moved relative to said lower member between a house ID display sign configuration and a support shelf configuration; and (d) an electrical circuit having a light mounted at a side edge portion of said lower member for providing illumination to an area adjacent thereto;

(e) said upper member having a lower edge portion disposed in a spaced relation from an upper edge portion of said lower member when said upper member is at said house ID display sign configuration relative to said lower member and disposed in a contacting relation with said upper edge portion of said lower member when said upper member is at said support shelf configuration relative to said lower member;

(f) said electrical circuit also having an electrical switch mounted at said upper edge portion of said lower member and being connected between a source of electrical power and said light, said electrical switch having a button projecting from said upper edge portion and being engaged and depressed by said lower edge portion of said upper member when said lower edge portion of said upper member is disposed in said contacting relation with said upper edge portion of said lower member.

11. The assembly of claim 10 wherein said source of electrical power is a direct current battery mounted at an opposite side edge portion of said lower member.

12. An assembly convertible between a house ID display sign and a support shelf, comprising:

(a) a lower base plate being stationarily attachable on a wall portion of a house adjacent to an entry door;

(b) an upper face plate for mounting ID indicia to identify the house;

(c) at least one pivotal hinge attached respectively to an upper edge portion of said lower base plate and a lower edge portion of said upper face member to enable said upper face plate to undergo pivotal movement relative to said lower base plate between a raised house ID display sign configuration in which said upper face plate is disposed adjacent the wall portion of the house and extends upwardly in coplanar relation with said lower base portion and a lowered support shelf configuration in which said upper face plate is displaced from the wall portion of the house and provides an outwardly projecting, generally horizontal support shelf for seating an object thereon; and (d) means on said lower base plate for engaging and supporting said upper face plate when said upper face plate is moved to said substantially perpendicular relation to said lower base plate so as to retain said upper face plate in said support shelf configuration when an object is placed on said upper face plate.

13. The assembly of claim 12 wherein said lower base plate has attaching means including a plurality of holes defined through said base plate and a plurality of fasteners installable through said holes.

14. The assembly of claim 12 wherein said upper face plate has an ID indicia mounting means including a bracket attached to a front side of said face plate having channels for removably receiving ID indicia.

15. An assembly convertible between a house ID display sign and a support shelf, comprising:

(a) a lower base plate being stationarily attachable on a wall portion of a house adjacent to an entry door;

(b) an upper face plate for mounting ID indicia to identify the house;

(c) at least one pivotal hinge attached respectively to an upper edge portion of said lower base plate and a lower edge portion of said upper face member to enable said upper face plate to undergo pivotal movement relative to said lower base plate between a raised house ID display sign configuration in which said upper face plate is disposed adjacent the wall portion of the house and extends upwardly in coplanar relation with said lower base portion and a lowered support shelf configuration in which said upper face plate is displaced from the wall portion of the house and provides an outwardly projecting, generally horizontal support shelf for seating an object thereon; and (d) an electrical circuit having a light mounted to said lower base plate for providing illumination to an area of the entry door adjacent thereto and an electrical switch mounted to said lower base member and being connected between a source of electrical power and said light.

16. An assembly convertible between a house ID display sign and a support shelf, comprising:

(a) a lower base plate being stationarily attachable on a wall portion of a house adjacent to an entry door;

(b) an upper face plate for mounting ID indicia to identify the house; and (c) at least one pivotal hinge attached respectively to an upper edge portion of said lower base plate and a lower edge portion of said upper face member to enable said upper face plate to undergo pivotal movement relative to said lower base plate between a raised house ID display sign configuration in which said upper face plate is disposed adjacent the wall portion of the house and extends upwardly in coplanar relation with said lower base portion and a lowered support shelf configuration in which said upper face plate is displaced from the wall portion of the house and provides an outwardly projecting, generally horizontal support shelf for seating an object thereon;

(d) said lower edge portion of said upper face plate being disposed in a spaced relation from said upper edge edge of said lower base plate when said upper face plate is at said raised ID display sign configuration relative to said lower base plate and being disposed in a contacting relation with said upper edge portion of said lower base plate when said upper face plate is at said lowered support shelf configuration relative to said lower base plate.

17. The assembly of claim 16 further comprising:

(d) an electrical circuit having a light mounted at a side edge portion of said lower base plate for providing illumination to an area of the entry door adjacent thereto.

18. The assembly of claim 17 wherein said electrical circuit also has an electrical switch mounted at said upper edge portion of said lower base plate and a direct current battery mounted at an opposite side edge portion of said lower base plate being connected between said switch and said light, said electrical switch having a button projecting from said upper edge portion of said lower base plate and being engaged and depressed by said lower edge portion of said upper face plate when disposed said lower edge of said upper face plate is disposed in said contacting relation with said upper edge portion of said lower base plate.

19. The assembly of claim 12 further comprising:

a finger gripping element attached to an upper edge portion of said upper face plate for use in pivotally moving said upper face plate between said raised and lowered configurations.

* * * * *